US005485875A

United States Patent [19]

Genova

[11] Patent Number: 5,485,875

[45] Date of Patent: Jan. 23, 1996

[54] WINDOW SHADE WITH BREAK-AWAY ATTACHMENT OF LIFT CORDS TO BOTTOM RAIL

[75] Inventor: John R. Genova, Madison, Wis.

[73] Assignee: Springs Window Fashions Division, Inc.

[21] Appl. No.: 220,663

[22] Filed: Mar. 31, 1994

[51] Int. Cl.[6] ..... E06B 9/30

[52] U.S. Cl. ..... 160/168.1; 160/178.1

[58] Field of Search ..... 160/115, 168.1 R, 160/178.1 R, 167 R, 173 R, 176.1 R, 178.3 R, 236; 16/122, 216, 217; 24/115 F, 602, 130, 129 R

[56] References Cited

U.S. PATENT DOCUMENTS

| | | | |
|---|---|---|---|
| 3,485,285 | 12/1969 | Anderle . | |
| 4,327,797 | 5/1982 | Nakajima et al. | 160/168.1 R |
| 4,719,955 | 1/1988 | Tachikawa et al. | 160/178.1 R |
| 4,733,625 | 3/1988 | Allen | 24/602 X |
| 4,909,298 | 3/1990 | Langhart et al. . | |

FOREIGN PATENT DOCUMENTS 399233 3/1966 Switzerland .

*Primary Examiner*—Blair M. Johnson
*Attorney, Agent, or Firm*—Vernon J. Pillote

[57] ABSTRACT

A window shade assembly comprising a header, a bottom rail and expansible and contractable shade means attached to the header and bottom rail, and lift cords attached to the bottom rail and extending upwardly to the header and through a cord lock on the header and having lift cord operating portions extending downwardly from the cord lock means for raising and lowering the bottom rail, the lower ends of the operating portions of the lift cords are detachably mounted on the bottom rail to be raised and lowered with the bottom rail to reduce cord dangle and the detachable mounting is arranged to allow the lower end of the operating portion of each lift cord to detach from the bottom rail and separate from the operating portions of the other lift cords when the lower end of the lift cord is subjected to a tensile force in a direction away from the bottom rail, for child safety reasons.

5 Claims, 1 Drawing Sheet

FIG. 1
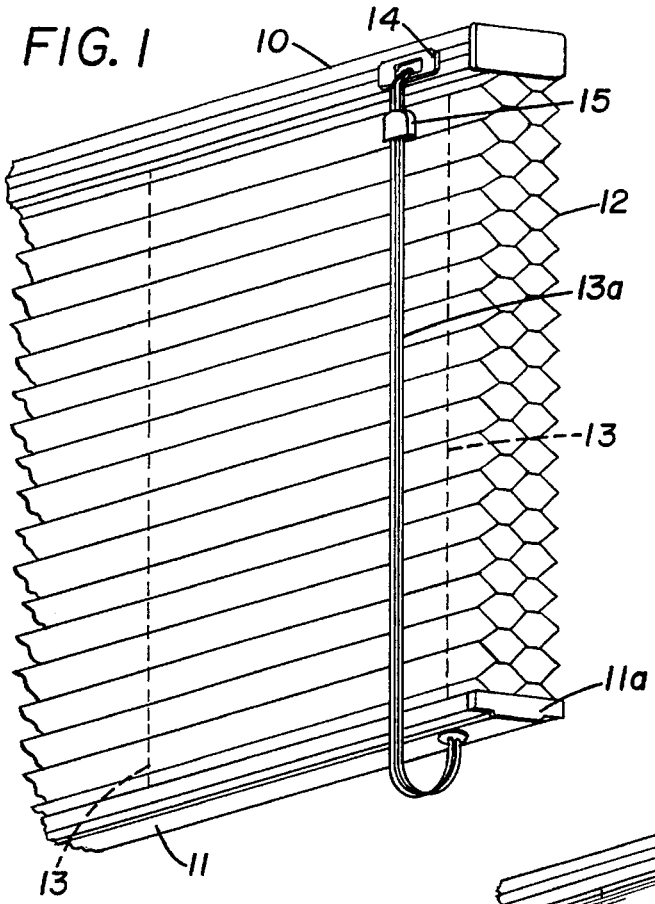
FIG. 4
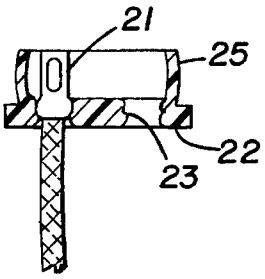
FIG. 2
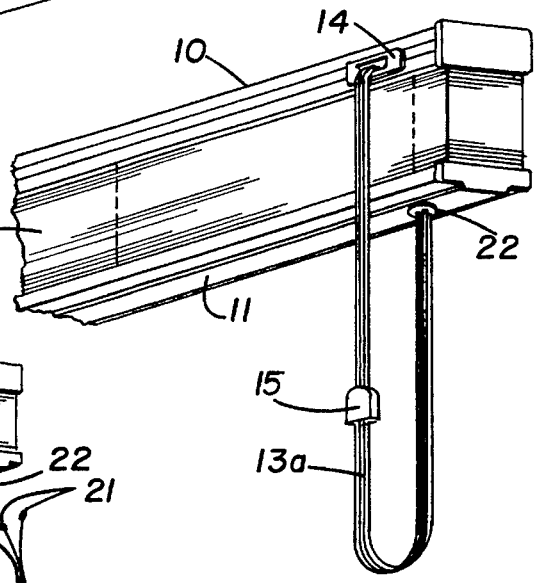
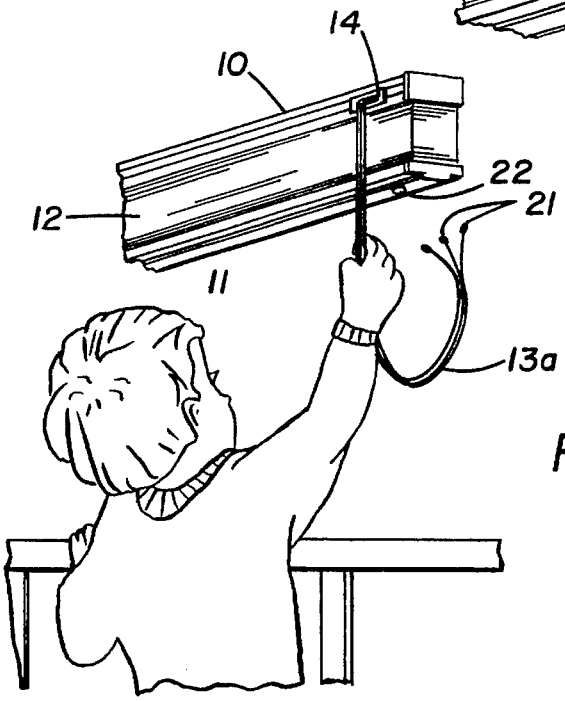
FIG. 3

WINDOW SHADE WITH BREAK-AWAY ATTACHMENT OF LIFT CORDS TO BOTTOM RAIL

BACKGROUND OF THE INVENTION

The present invention relates to window shades of the type in which lift cords are attached to the bottom rail and extend upwardly to a header and through a cord lock on the header with operating portions extending downwardly from the cord lock. The operating portions are manually pulled downwardly to raise the bottom rail and, when the bottom rail is fully raised, the operating portion of the lift cords will frequently extend below the window sill and even adjacent to or onto the floor. The low dangling cords not only present an untidy appearance, but also present a potential hazard to children who sometimes play with and become entangled with the cords.

U.S. Pat. No. 3,485,285 discloses a blind construction in which the operating portion of the lift cords is in the form of a loop and the lower end of the loop is attached to the bottom rail to be raised and lowered with the bottom rail. Since the lower end of the operating cord loop moves upwardly as the bottom rail is raised, this arrangement effectively overcomes the problem of dangling of the lift cord on or adjacent the floor when the bottom rail is raised. However, the operating cords when attached to the bottom rail, form a loop which could constitute a noose if a child places his head in the loop. Further, since the operating cords are connected into a continuous loop at their lower ends, the danger also exists that a child could be injured by placing his head between the interconnected operating cords.

U.S. Pat. No. 4,909,298 discloses a cord pull for detachably interconnecting the lower ends of the operating portions of the venetian blind lift cords. This is intended to allow the lower ends of the lift cords to separate when a force is applied to the cord pull at a location between the cords. In order to position the otherwise dangling ends of the cords at a safe vertical distance above the floor, this patent suggests wrapping the cords around the cord pull members and attaching the cord pull members to the headrail or to an upper portion of the window frame. However, this requires a special manual operation after the shade is raised in order to store the dangling ends of the lift cords, and a further manual operation to reverse the storage of the lift cords prior to lowering of the shade.

BRIEF DESCRIPTION OF THE DRAWINGS

FIG. 1 is a perspective view of a window shade embodying the invention showing the lift cords when the window shade is in a lowered position;

FIG. 2 is a fragmentary perspective view illustrating the lift cords when the window shade is raised;

FIG. 3 is a fragmentary perspective view illustrating the detachment of the lift cords from the bottom rail; and FIG. 4 is a fragmentary sectional view through the means for mounting the ends of the lift cord on the bottom rail.

DETAILED DESCRIPTION

The present invention relates to window shades of the type having a header 10, a bottom rail 11 and expansible and contractable shade means 12 attached to and extending between the header and the bottom rail. The expansible and collapsible shade means 12 can be of folded or cellular material or of the venetian blind type in which slats are supported on ladder tapes. The bottom rail is adapted to be raised and lowered by lift cords 13 that are attached at one end to the bottom rail 11 and extend upwardly through the shade and into the header 10 and exit from a cord lock 14 on the header. The lift cords have operating portions 13i a that extend downwardly from the headrail and which are operative, when pulled downwardly, to raise the bottom rail from the fully lowered position as shown in FIG. 1 to a raised position as shown in FIGS. 2 and 3. As is conventional, the cord lock 14 is arranged to lock the lift cords against movement in different vertically adjusted positions of the bottom rail between the fully lowered position and the fully raised position and the cord lock means is operated between its lock and release conditions in response to lateral shifting of the operating portion of the lift cord. A cord equalizer 15, for example of the type shown in U.S. Pat. No. 5,058,650, is commonly provided on the lift cords to equalize movement of the lift cords and maintain the bottom rail generally horizontal during raising and lowering of the shade.

In accordance with the present invention, means are provided for detachably mounting the lower ends of the lift cord operating portion on the bottom rail so that the lower ends of the lift cord normally move with the bottom rail. Thus, when the operating portions 13*a* are pulled downwardly, the bottom rail 11 is raised and the lower ends of the upper end portions are drawn upwardly to limit downward dangle of the lift cords. The attachable mounting means is constructed and arranged to allow the lower ends of the lift cord operating portions to detach from the bottom rail and separate from the depending portions of other lift cords, when the lower end of the lift cord is subjected to a tensile force in a direction away from the bottom rail. The operating portion of the lift cords between the headrail and bottom rail forms a slack loop as shown in FIGS. 1 and 2. However, if a child is caught in a loop formed by one or more or all of the lift cords, the lift cords can individually detach from the bottom rail and thus break up not only the loop formed by attaching the ends of the lift cords to the bottom rail, but also the loop or loops formed between adjacent ones of the lift cords.

In the preferred embodiment illustrated, cord end members 21 are molded or crimped onto the lower end of each lift cord operating portion and a mounting member 22 is provided with a plurality of sockets 23, at least equal in number to cords in the lift cord operating portion 13*a*. The mounting portion is preferably formed of a resilient plastic material to facilitate detachment and reinstallation of the lift cord end members. In the embodiment illustrated, the mounting member 22 is formed with a collar 25 adapted to be inserted through an opening in the bottom rail and which is shaped to normally retain the mounting member on the bottom rail. It is also contemplated that the mounting member 22 could be formed as a part of an end cap such as shown at 11*a* on the bottom rail. In order to facilitate detachment of the cord end members 21 from the mounting member 22, the sockets 23 on the mounting member are preferably leach arranged to open in a generally downwardly facing direction so that a relatively low downward tension on a lift cord will pull the associated lift cord end member out of the socket in the mounting member 22 to minimize the likelihood of a child being strangled if it gets its head in a cord loop.

From the foregoing it is believed that the operation and construction of the window shade assembly will be readily understood. Attachment of the lower ends of the lift cord operating portion, raises the lower ends of the lift cord operating portion as the window shade is raised so that the vertical height of the loop formed in the cord operating portions remains substantially constant. This reduces the likelihood that a child on the floor would be able to reach the operating cords. Further, the detachable mounting of the lower ends of the lift cord operating portions on the bottom rail allows the lift cord end members to individually detach from the bottom rail and to separate from each other so as to not only break up the loop in the operating cord formed between the header and bottom rail, but also the loops formed between adjacent ones of the lift cord operating portions.

The embodiments of the invention in which an exclusive property or privilege is claimed are defined as follows:

1. A window shade assembly comprising a header, a bottom rail and expansible and contractable shade means attached to the header and bottom rail, bottom rail operating means including at least two lift cords attached to the bottom rail and extending upwardly to the header and through cord lock means on the header, the bottom rail operating means including at least one operating portion extending downwardly from the cord lock means and manually operable for moving the bottom rail between upper and lower positions, the operating portion having a length sufficient to extend below the lower rail when the latter is in said lower position thereof, a cord end member on a lower end of the operation portion, and means detachably mounting the cord end member on the bottom rail, the detachable mounting means being constructed and arranged to allow the cord end member to detach from the mounting means on the bottom rail when the associated operating portion is subjected to a tensile force in a direction away from the bottom rail.

2. A window shade assembly comprising a header, a bottom rail and expansible and contractable shade means attached to the header and bottom rail, at least two lift cords attached to the bottom rail and extending upwardly to the header and through cord lock means on the header and having depending portions extending downwardly from the cord lock means and manually operable to move the bottom rail between upper and lower positions, the dependent portions having a length sufficient to extend below the bottom rail when the latter is in said lower position thereof, and means detachably mounting lower ends of the depending portions of the lift cords on the bottom rail to be raised and lowered with the bottom rail, the detachable mounting means being constructed and arranged to allow the lower end of the depending portion of each lift cord to detach from the bottom rail and separate from the depending portions of the other lift cords when the lower end of the lift cord is subjected to a tensile force in a direction away from the bottom rail.

3. A window shade assembly comprising a header, a bottom rail and expansible and contractable shade means attached to the header and bottom rail, at least two lift cords attached to the bottom rail and extending upwardly to the header and through cord lock means on the header and having operating end portions extending downwardly from the cord lock means and manually operable to move the bottom rail between upper and lower positions, the lift cords having a length sufficient to extend below the bottom rail when the latter is in said lower position thereof, a cord end member on a lower end of the operating portions of each lift cord, and means detachably mounting the cord end members on the bottom rail, the detachable mounting means being constructed and arranged to allow the cord end members to individually detach from the mounting means on the bottom rail and separate from the other connector members when the associated operating portion is subjected to a tensile force in a direction away from the mounting means on the bottom rail.

4. A window shade assembly according to claim 3 wherein the mounting means has a plurality of sockets and each cord end member is arranged for releasable reception in a socket.

5. A window shade assembly according to claim 4 wherein the sockets each open in a generally downwardly facing direction.

* * * * *